US011551540B2

(12) United States Patent
Vishnoi et al.

(10) Patent No.: US 11,551,540 B2
(45) Date of Patent: Jan. 10, 2023

(54) METHODS AND SYSTEMS FOR SOCIAL DISTANCING

(71) Applicant: Hand Held Products, Inc., Charlotte, NC (US)

(72) Inventors: Neha Vishnoi, Hyderabad (IN); Pavan Bandhil, Hyderabad (IN); Toleti Jayasree, Hyderabad (IN); Vikas Sirigiri, Hyderabad (IN)

(73) Assignee: Hand Held Products, Inc., Charlotte, NC (US)

( * ) Notice: Subject to any disclaimer, the term of this patent is extended or adjusted under 35 U.S.C. 154(b) by 0 days.

(21) Appl. No.: 17/301,594

(22) Filed: Apr. 8, 2021

(65) Prior Publication Data

US 2022/0277639 A1 Sep. 1, 2022

(30) Foreign Application Priority Data

Feb. 23, 2021 (IN) ..... 202111007528

(51) Int. Cl.
*G08B 13/14* (2006.01)
*G08B 21/24* (2006.01)

(52) U.S. Cl.
CPC ..... *G08B 21/245* (2013.01)

(58) Field of Classification Search
CPC ..... G08B 21/245; H04W 4/023; H04W 4/80; H04B 17/27; G01S 17/08; G06K 9/6215
See application file for complete search history.

(56) References Cited

U.S. PATENT DOCUMENTS

| | | | | |
|---|---|---|---|---|
| 7,496,157 | B2 | 2/2009 | Katou et al. | |
| 10,231,440 | B2 | 3/2019 | Seltzer et al. | |
| 10,372,234 | B2 * | 8/2019 | Wang | G06F 3/0304 |
| 11,176,790 | B1 * | 11/2021 | Liszt | G08B 21/0272 |
| 11,354,996 | B1 * | 6/2022 | Candelore | G08B 21/02 |
| 2014/0113558 | A1 | 4/2014 | Varoglu et al. | |
| 2015/0241962 | A1 | 8/2015 | Reznik et al. | |
| 2016/0232771 | A1 | 8/2016 | Mendiola et al. | |

(Continued)

OTHER PUBLICATIONS

Johnson, Jr. et al., "Social-Distancing Monitoring Using Portable Electronic Devices", Technical Disclosure Commons, (Apr. 17, 2020) https://www.tdcommons.org/dpubs_series/3158.

(Continued)

*Primary Examiner* — An T Nguyen
(74) *Attorney, Agent, or Firm* — Alston & Bird LLP

(57) ABSTRACT

A system for generating an alert in case of a social distancing breach in a facility including a first device and second device, each including a processor and a memory. The memory stores executable instructions that, when executed by the processor, facilitate performance of operations. The operations including receiving a first beacon signal from a second device and determining that a first condition associated with a payload of the first beacon signal is satisfied, determining that a second condition associated with a distance between the first device and the second device is satisfied. The operations further comprising generating an alert related to a social distancing warning in response to the first condition and the second condition being satisfied and in response to at least one of the first condition or second condition not being satisfied, not generating the alert.

18 Claims, 6 Drawing Sheets

(56) References Cited

U.S. PATENT DOCUMENTS

| | | | | |
|---|---|---|---|---|
| 2018/0206177 | A1 | 7/2018 | Daoura et al. | |
| 2021/0289319 | A1* | 9/2021 | Antony | G06F 8/65 |
| 2021/0295662 | A1* | 9/2021 | Bugbee | G08B 21/22 |
| 2021/0314727 | A1* | 10/2021 | Bianchini | G08B 7/06 |
| 2021/0314729 | A1* | 10/2021 | Morgenthau | A61B 5/0022 |
| 2021/0319912 | A1* | 10/2021 | Bandy | G01S 15/08 |
| 2021/0350686 | A1* | 11/2021 | Tabor | G08B 21/0266 |
| 2021/0360366 | A1* | 11/2021 | Bailey | G08B 7/06 |
| 2021/0392455 | A1* | 12/2021 | Hong | H04W 4/80 |
| 2022/0050199 | A1* | 2/2022 | Waldron | G08B 21/22 |
| 2022/0086597 | A1* | 3/2022 | Chandel | H04Q 9/00 |

OTHER PUBLICATIONS

European search report dated Apr. 29, 2022 for EP Application No. 22158271.

* cited by examiner

METHODS AND SYSTEMS FOR SOCIAL DISTANCING

CROSS-REFERENCE TO RELATED APPLICATIONS

This application claims priority to and the benefit of foreign Indian Provisional Patent Application Serial No. 202111007528, filed on Feb. 23, 2021 with the Government of India Patent Office and entitled "Methods And Systems For Social Distancing," which is incorporated herein by reference in its entirety.

TECHNOLOGICAL FIELD

Example embodiments of the present invention relate generally to systems and methods for maintaining social distancing, and, more particularly, to systems and methods for maintaining social distancing between the multiple operators in any environment and generating alerts to maintain the social distancing.

BACKGROUND

Generally speaking wireless technology may be a useful tool to communicate with multiple mobile devices to identify a location and a position of an operator/employee in any indoor environment, such as a warehouse facility. There are many situations where knowing the location and the position of the operator/employee using the wireless technology is important but the environment and the associated mobile device may present several challenges. Specifically, during the COVID-19 pandemic, social distancing between operators/employees has become a norm to be implemented in the indoor environment. In order to maintain the social distancing, it is important to accurately identify the location, the position and distance between operators/employees carrying the mobile devices.

SUMMARY

The following presents a simplified summary to provide a basic understanding of some aspects of the disclosed material handling system. This summary is not an extensive overview and is intended to neither identify key or critical elements nor delineate the scope of such elements. Its purpose is to present some concepts of the described features in a simplified form as a prelude to the more detailed description that is presented later.

Various example embodiments described herein relate to a first device including a processor and a memory. The memory stores executable instructions that, when executed by the processor, facilitate performance of operations. The operations including receiving a first beacon signal from a second device and determining that a first condition associated with a payload of the first beacon signal is satisfied, determining that a second condition associated with a distance between the first device and the second device is satisfied. The operations further comprising generating an alert related to a social distancing warning in response to the first condition and the second condition being satisfied and in response to at least one of the first condition or second condition not being satisfied, not generating the alert.

Various example embodiments described herein relate to the first device, wherein the first condition is satisfied if a byte in the payload of the first beacon signal is set to a first value and wherein the first condition is not satisfied if the byte is set to a second value.

Various example embodiments described herein relate to the first device, wherein the second condition is satisfied if the distance between the first device and the second device is less than a predefined distance.

Various example embodiments described herein relate to the first device, wherein the operations further including determining the distance between the first device and the second device based on a received signal strength of the first beacon signal.

Various example embodiments described herein relate to the first device, wherein the alert is at least one of an audio alert or a visual alert.

Various example embodiments described herein relate to the first device, wherein in response to a sensor detecting no motion for a predefined duration of time, ceasing monitoring for beacon signals from other devices.

Various example embodiments described herein relate to the first device, wherein the operations including determining a payload for a second beacon signal, wherein the payload is determined based on motion being detected by a sensor on the first device within a predefined time period. The operations further comprising transmitting the second beacon signal with a first payload in response to detecting motion within the predefined time period or a second payload in response to not detecting motion within the predefined time period.

Various example embodiments described herein relate to the first device, wherein the operations including transitioning the first device from an active mode to an idle mode in response to transmitting the second beacon signal with the second payload, wherein in the idle mode the first device does not receive the payload of the first beacon signal.

Various example embodiments described herein relate to the first device, wherein the operations including repeating the transmission of the second beacon signal at a predefined time interval.

Various example embodiments described herein relate to the first device, wherein the operations including, wherein the predefined time interval is one second.

Various example embodiments described herein relate to a method including receiving, by a first device comprising a processor, a first beacon signal from a second device and determining, by the first device, that a first condition associated with a payload of the first beacon signal is satisfied, and determining, by the first device, that a second condition associated with a distance between the first device and the second device is satisfied. The method further includes generating an alert related to a social distancing warning; and wherein the determination of the first condition and the determination of the second condition are interdependent and in response to at least one of the first condition or second condition not being satisfied, not generating, by the first device, the alert.

Various example embodiments described herein relate to a method including determining the first condition has been satisfied further comprises determining that a byte in the payload of the first beacon signal is set to a first value and wherein the first condition is not satisfied if the byte is set to a second value.

Various example embodiments described herein relate to a method including determining that the second condition has been satisfied further comprises determining that the distance between the first device and the second device is less than a predefined distance.

Various example embodiments described herein relate to a method including determining the distance between the first device and second device is based on a received signal strength of the first beacon signal.

Various example embodiments described herein relate to a method including ceasing monitoring for incoming beacon signals in response to a sensor of the first device detecting no motion for a predefined time period.

Various example embodiments described herein relate to a method including determining, by the first device, a payload for a second beacon signal, wherein the payload is determined based on motion being detected by the sensor within a predefined time period. The method further includes transmitting, by the first device, the second beacon signal with a first payload in response to detecting motion within the predefined time period or a second payload in response to not detecting motion within the predefined time period.

Various example embodiments described herein relate to a method including transitioning the first device from an active state to a sleep state when transmitting the second beacon signal with the second payload, wherein in the sleep state the first device does not receive the payload of the first beacon signal.

Various example embodiments described herein relate to a machine-readable storage medium, comprising executable instructions that, when executed by a processor of a device, facilitate performance of operations. The operations including receiving a first beacon signal from a second device. In response to determining that a first condition associated with a payload of the first beacon signal is satisfied, determining that a second condition associated with a distance between the first device and the second device is satisfied, generating an alert related to a social distancing warning. In response to at least one of the first condition or second condition not being satisfied, not generating the alert.

Various example embodiments described herein relate to a machine-readable storage medium, comprising executable instructions that, when executed by a processor of a device, facilitate performance of operations. The operations including determining a payload for a second beacon signal, wherein the payload is determined based on motion being detected by a sensor within a predefined time period and transmitting the second beacon signal with a first payload in response to detecting motion within the predefined time period or a second payload in response to not detecting motion within the predefined time period.

Various example embodiments described herein relate to a machine-readable storage medium, comprising executable instructions that, when executed by a processor of a device, facilitate performance of operations. The operations including repeating the transmission of the second beacon signal at a predefined time interval.

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
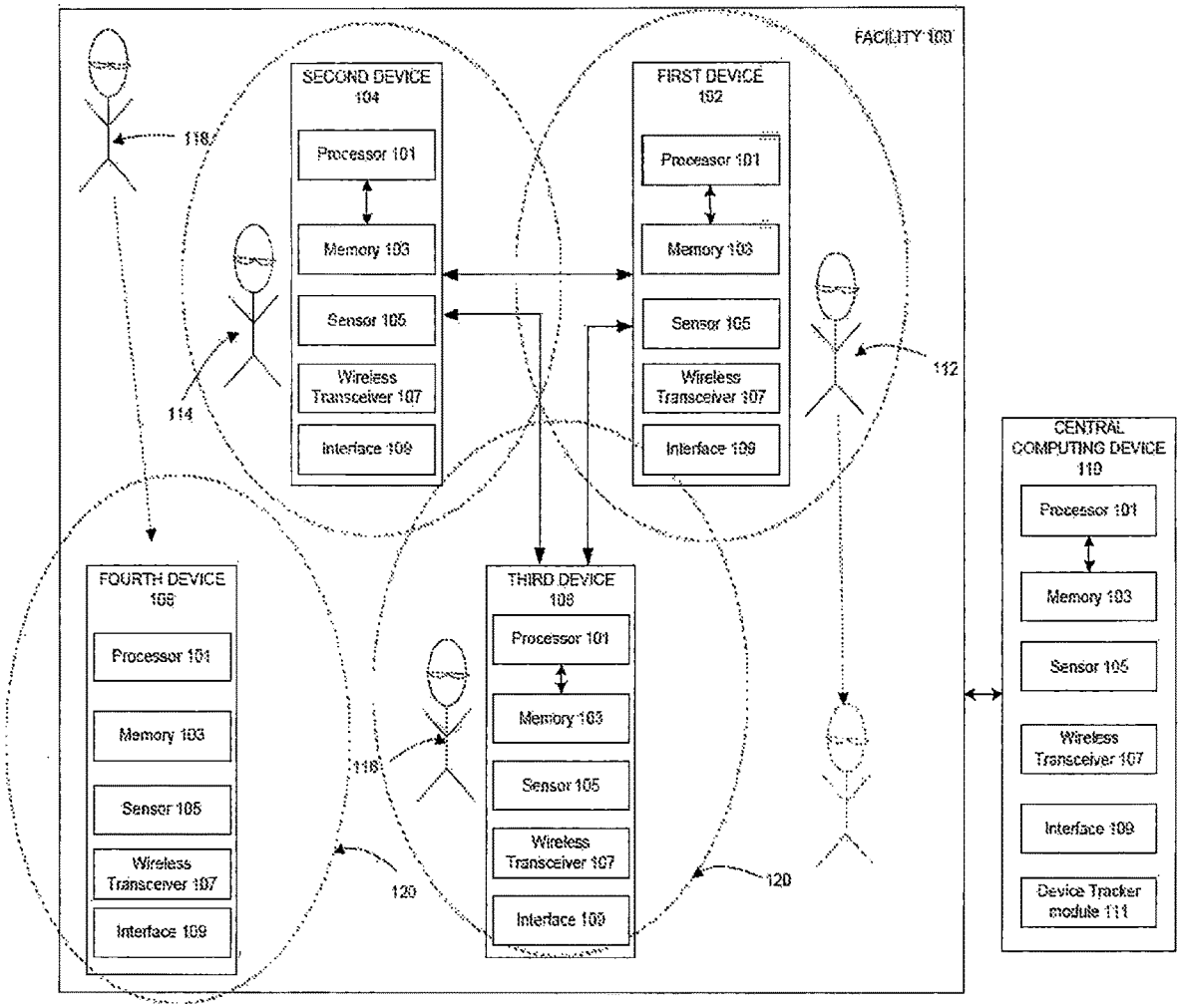
FIG. 1 illustrates a schematic diagram of a network of mobile devices within a facility in accordance with an embodiment of the present invention.

Some embodiments of the present invention will now be described more fully hereinafter with reference to the accompanying drawings, in which some, but not all embodiments of the inventions are shown. Indeed, the disclosure may be embodied in many different forms and should not be construed as limited to the embodiments set forth herein; rather, these embodiments are provided so that this disclosure will satisfy applicable legal requirements. The terms "or" and "optionally" are used herein in both the alternative and conjunctive sense, unless otherwise indicated. The terms "illustrative" and "exemplary" are used to be examples with no indication of quality level. Like numbers refer to like elements throughout.

The components illustrated in the figures represent components that may or may not be present in various embodiments of the invention described herein such that embodiments may include fewer or more components than those shown in the figures while not departing from the scope of the invention.

Turning now to the drawings, the detailed description set forth below in connection with the appended drawings is intended as a description of various configurations and is not intended to represent the only configurations in which the concepts described herein may be practiced. The detailed description includes specific details for the purpose of providing a thorough understanding of various concepts with like numerals denote like components throughout the several views. However, it will be apparent to those skilled in the art that these concepts may be practiced without these specific details.

The term "processor" is used herein to refer to devices which can be configured to perform the various functionality set forth in this disclosure, either individually or in combination with other devices. Examples of processors may include microprocessors, microcontrollers, digital signal processors (DSPs), field programmable gate arrays (FPGAs), programmable logic devices (PLDs), programmable logic controllers (PLCs), state machines, gated logic, and discrete hardware circuits. The term "processing system" may be used to refer to one or more processors, which may be included in a single device, or distributed among multiple physical devices.

According to the present subject matter, the term "module" or "component" may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by the processor; other suitable hardware components that provide the described functionality; or a combination of some or all of the above, such as in a system-on-chip.

The term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of. Furthermore, to the extent that the terms "includes" and "including" and variants thereof are used in either the detailed description or the claims, these terms are intended to be inclusive in a manner similar to the term "comprising."

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

Moreover, the word "exemplary" is used herein to mean "serving as an example, instance, or illustration." Any implementation, aspect, or design described herein as "exemplary" is not necessarily to be construed as preferred or advantageous over other implementations, aspects, or designs. Rather, use of the word exemplary is intended to present concepts in a concrete fashion.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

As used in this application, the terms "component", "controller", "system", "circuitry" and the like are generally intended to refer to a computer-related entity or an entity related to an operational machine with one or more specific functionalities. The entities disclosed herein can be either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers. These components also can execute from various computer readable storage media having various data structures stored thereon. The component may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry that is operated as software or firmware application (s) executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. An interface can comprise input/output (I/O) components as well as associated processor, application, and/or API components.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multi-thread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor also can be implemented as a combination of computing processing units.

In the subject specification, terms such as "memory", "store," "data store," "data storage," "database," "repository," "queue", and substantially any other information storage component relevant to operation and functionality of a component, refer to "memory components," or entities embodied in a "memory" or components comprising the memory. It will be appreciated that the memory components described herein can be either volatile memory or nonvolatile memory, or can comprise both volatile and nonvolatile memory. In addition, memory components or memory elements can be removable or stationary. Moreover, memory can be internal or external to a device or component, or removable or stationary. Memory can comprise various types of media that are readable by a computer, such as hard-disc drives, zip drives, magnetic cassettes, flash memory cards or other types of memory cards, cartridges, or the like.

By way of illustration, and not limitation, nonvolatile memory can comprise read only memory (ROM), programmable ROM (PROM), electrically programmable ROM (EPROM), electrically erasable ROM (EEPROM), or flash memory. Volatile memory can comprise random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRAM). Additionally, the disclosed memory components of systems or methods herein are intended to comprise, without being limited to comprising, these and any other suitable types of memory.

As it employed in the subject specification, the term "Bluetooth Low Energy (BLE)" is a feature of Bluetooth 4.0 wireless radio technology, aimed at new, principally low-power and low-latency, applications for wireless devices within a short range (up to 50 meters/160 feet). This facilitates a wide range of applications and smaller form factor devices. Bluetooth Low Energy (BLE) has the ability to exchange data in one of two states: connected and advertising modes. Connected mode uses the Generic Attribute (GATT) layer to transfer data in a one-to-one connection. Advertising mode uses the Generic Access Profile (GAP) layer to broadcast data. BLE Beacons take advantage of the GAP advertising mode to broadcast data out in periodic, specially formatted advertising data packets.

As it employed in the subject specification, the term "device" or "mobile device" generally refers to any portable mobile handset with or without cellular telephonic communications capabilities but with computing capabilities, and wireless local/short-range data communication capabilities (e.g. Bluetooth, RFID, NFC etc.). An example of the "mobile device" may be a smart phone enabled with Bluetooth technology, and most preferably enabled with Bluetooth Low Energy (BLE) capabilities.

As it employed in the subject specification, the term "Received Signal Strength Indicator (RSSI)" is a measurement of the power present in a received radio signal. Such signal strength may be used by the mobile device to compute one or more parameters to identify the location, the position of the mobile device and the distance between two or more mobile devices.

As it employed in the subject specification, the term 'communication' between the mobile devices can be two-way communication or only one-way communication. An example of the communication technology is Bluetooth, but it is understood that the use of Bluetooth technology herein is merely exemplary and that other communication technologies such as, but not limited to, RFD), NFC IrDA, RF, UWB and others may be employed in place of Bluetooth.

In particular and in regard to the various functions performed by the above described components, devices, circuits, systems and the like, the terms (including a reference to a "means") used to describe such component are intended to correspond, unless otherwise indicated, to any component which performs the specified function of the described component (e.g., a functional equivalent), even though not structurally equivalent to the disclosed structure, which performs the function in the herein illustrated example aspect of the embodiments. In this regard, it will also be recognized that the embodiments comprise a system as well as a computer-readable medium having computer-executable instruction for performing the acts and/or events of the various methods.

Computing devices typically comprise a variety of media, which can comprise "computer-readable storage media" and/or "communications media," which two terms are used herein differently from one another as follows. "Computer-readable storage media" can be any available storage media that can be accessed by the computer and comprises both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can comprise, but are not limited to, RAM, ROM, EEPROM, flash memory or other memory technology, CD-ROM, digital versatile disk (DVD) or other optical disk storage, magnetic cassettes, magnetic tapes, magnetic disk storage or other magnetic storage devices, or other tangible and/or non-transitory media which can be accessed by one or more local or remote computing devices, e.g., via access requests, queries or other data retrieval protocols, for a variety of operations with respect to the information stored by the medium.

The system and method disclosed herein may be implemented via one or more components, systems, servers, appliances, other subcomponents, or distributed between such elements. When implemented as a system, such systems may include an/or involve, inter alia, components such as software modules, general-purpose CPU, RAM, etc. found in general-purpose computers. In implementations where the innovations reside on a server, such a server may include or involve components such as CPU, RAM, etc., such as those found in general-purpose computers.

Additionally, the system and method herein may be achieved via implementations with disparate or entirely different software, hardware and/or firmware components, beyond that set forth above. With regard to such other components (e.g., software, processing components, etc.) and/or computer-readable media associated with or embodying the present inventions, for example, aspects of the innovations herein may be implemented consistent with numerous general purpose or special purpose computing systems or configurations. Various exemplary computing systems, environments, and/or configurations that may be suitable for use with the innovations herein may include, but are not limited to: software or other components within or embodied on personal computers, servers or server computing devices such as routing/connectivity components, handheld or laptop devices, multiprocessor systems, microprocessor-based systems, set top boxes, consumer electronic devices, network PCs, other existing computer platforms, distributed computing environments that include one or more of the above systems or devices, etc.

In some instances, aspects of the system and method may be achieved via or performed by logic and/or logic instructions including program modules, executed in association with such components or circuitry, for example. In general, program modules may include routines, programs, objects, components, data structures, etc. that perform particular tasks or implement particular instructions herein. The inventions may also be practiced in the context of distributed software, computer, or circuit settings where circuitry is connected via communication buses, circuitry or links. In distributed settings, control/instructions may occur from both local and remote computer storage media including memory storage devices.

Throughout the specification, the terms "operator", "employee", "user" may be used interchangeably to refer to any person who is in possession of a mobile device with wireless capabilities.

Generally, during the COVID-19 pandemic, social distancing has become a norm to be followed in day today work in any business environment. For example, industries that require clearance from government to open the businesses need to be complaint with the social distancing norms. A frequent breach of this norm could give an indication that the industries are non-complaint, which may pose a difficulty in normal operation of the industries to run the businesses. A conventional approach to this problem is to use a bluetooth based proximity detection in which a proximity of two mobile devices is determined based on a computation. The mobile devices may be carried by an operator/employee working in the industrial/business environment. However, Applicant has identified certain challenges when using the bluetooth based proximity detection for locating the mobile devices. An example of one such challenge is when the operator/employee has left his/her mobile device idle at a location within the industrial/business environment without carrying the mobile device while maneuvering in the industrial/business environment. In such scenarios, while using the bluetooth based proximity detection technique, there exists a possibility of a false proximity alert being triggered to another mobile device in proximity to the mobile device remaining idle at the location. Such false proximity alert is due to the fact that the operator/employee has left the mobile device idle at the location without any physical presence of the operator/employee at that location. Therefore, such false proximity alert may lead to a false record of social distancing breach and could severely impact the business even though the operators/employees maintain social distancing. As a result of the false record, clearance from government to open the businesses may be hindered.

Through applied effort, ingenuity, and innovation, many of the above identified problems have been solved by developing solutions that are included in embodiments of the present disclosure, many examples of which are described in detail herein. The present disclosure relates to mobile devices configured to generate alert when there is a social distancing breach. The mobiles devices includes a first device and second device. The first device comprising a processor and a memory that stores executable instructions that, when executed by the processor, facilitate performance of operations, comprising receiving a first beacon signal from the second device. After, receiving he first beacon signal, determining whether a first condition associated with a payload of the first beacon signal is satisfied and whether a second condition associated with a distance between the first device and the second device is satisfied. In response to the first condition and the second condition being satisfied, generating an alert related to a social distancing warning. In response to the first condition and the second condition not being satisfied, not generating the alert.

According to an embodiment, the first condition is satisfied if a byte in the payload of the first beacon signal is set to a first value and wherein the first condition is not satisfied if the byte is set to a second value. Further, the second condition is satisfied if the distance between the first device and the second device is less than a predefined distance.

According to an embodiment, the distance between the first device and the second device based on a received signal strength of the first beacon signal and subsequent beacon signals.

According to an embodiment, the alert generated is at least one of an audio alert or a visual alert.

According to an embodiment, when a sensor of the first device detects no motion for a predefined duration of time, the first device ceases to monitor beacon signals from other devices.

In the following detailed description of exemplary embodiments of the disclosure, specific representative embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from the general scope of the disclosure. The following detailed description is, therefore, not to be taken in a limiting sense, and the scope of the present disclosure is defined by the appended claims and equivalents thereof.

As it employed in the subject specification, the term "beacon signal", "beacon payload", or "payload signal" or "payload data" may refer to advertising data packets exchanged between mobile devices using certain advertising protocols, such as, but not limited to, AltBeacon Protocol, Google Protocol and iBeacon Protocol.

As it employed in the subject specification, the term "vicinity" and "proximity", as used herein, refer to physical close proximity between two mobile devices with a wireless module, which can be defined as a range of distance between the two mobile devices. The range indicates an ability to initiate a bluetooth discovery or other wireless discovery. In other words, "vicinity" and "proximity" is defined as an upper range of data communication capabilities for short-range communication technology. The upper range may differ based on a communication technology being used.

Referring now specifically to the drawings and the illustrative embodiments depicted therein, FIG. 1 illustrates a schematic diagram of a network of mobile devices within a facility 100 in accordance with an embodiment of the present invention. FIG. 1 illustrates a facility 100 with multiple mobile devices communicably coupled to a central computing device 110 over a wireless network. The mobile devices comprise a first device 102, a second device 104, a third device 106 and a fourth device 108. It is understood that multiple devices 102,104,106,108 may be present within the facility 100, and for ease of explanation of various aspects and embodiments of the present disclosure, only four devices are shown. Each of these devices 102,104,106, 108 are carried by an operator 112, 114, 116, 118 associated with these devices 102,104,106,108. The operator 112, 114, 116, 118 can maneuver with their associated device within the facility 100 to perform various operations within the facility 100.

According to an embodiment, each of the devices 102, 104,106,108 can be configured to implement either a two-way communication or only one-way communication. These communications may occur as either Local Area Wireless Communication and Wide Area Wireless Communication. A communication medium for establishing the wireless communication may include, but not limited to, sound waves, electromagnetic energy such as radio waves, light waves and the like. An example of the Local Area Wireless Communication referred to in this subject specification is a Bluetooth lower energy (BLE) communication, but it is understood that the use of Bluetooth communication herein is merely exemplary and that other communication technologies such as, but not limited to, RFID, NFC IrDA, UWB and others may be employed in place of Bluetooth. Examples of wide area wireless communication include cellular communication, Wi-Fi and satellite communication. According to an embodiment, the multiple devices 102,104,106,108 may be communicably coupled via the Local Area Wireless Communication and the multiple devices 102,104,106,108 may be communicably coupled with the central computing device 110 via the Wide Area Wireless Communication. The multiple devices 102,104,106,108 can be a phone (e.g., smartphone such as an Apple® iPhone® or Android® OS based device), personal digital assistant (PDA), tablet, and/or wearable device. In addition to hardware components, the devices can include one or more software applications (e.g., apps) which can define and/or control communications between the multiple devices 102,104,106,108, the central computing device 110, and/or other devices within the facility 100.

Though in the example illustrated in FIG. 1, the central computing device 110 is shown external or remote with respect to the facility 100, embodiments of the present disclosure are not so limited. In some embodiments, the central computing device 110 is internal or local with respect to the facility 100. In some examples, the central computing device 110 can include equivalent or additional hardware components and software applications compared to the devices 102,104,106,108. In some examples, the central computing device 110 is connected to the multiple devices 102,104,106,108 using communication which may include, but is not limited to, cellular communication, Ethernet communication, Bluetooth low energy (BLE) communication, and Wi-Fi communication based on a location (e.g., remote or local with respect to the facility 100) of the central computing device 110. In some examples, the multiple devices 102,104,106,108 may include Wi-Fi modules which connects to a local Wi-Fi router, and then connect to the central computing device 110. In some examples, the central computing device 110 may act as a LAN server or cloud server with information about the devices within the facility 100.

According to an exemplary embodiment shown in FIG. 1, each if the multiple devices 102,104,106,108 comprise a processor 101, a memory 103, a sensor 105, a wireless transceiver 107, and an interface 109. In some examples, the processor 101 may represent a single processor or multiple processors with a single processor core or multiple processor cores included therein. Processor 101 may represent one or more general-purpose processors such as a microprocessor, a central processing unit (CPU), or the like. More particularly, processor 101 may be a complex instruction set computing (CISC) microprocessor, reduced instruction set computing (RISC) microprocessor 101, very long instruction word (VLIW) microprocessor, or processor implementing other instruction sets, or processors implementing a combination of instruction sets. Processor 101 may also be one or more special-purpose processors such as an application specific integrated circuit (ASIC), a cellular or baseband processor, a field programmable gate array (FPGA), digital signal processor (DSP), a network processor, a graphics processor, a network processor, a communications processor, a cryptographic processor, a co-processor, an embedded processor, or any other type of logic capable of processing instructions.

In some examples, the memory 103 can be a machine readable non-transitory storage medium such as one or more volatile storage (or memory 103) devices such as random access memory (RAM), dynamic RAM (DRAM), synchronous DRAM (SDRAM), static RAM (SRAM), or other types of storage devices such as hard drives and flash memory. Memory 103 may store information including sequences of executable program instructions that are executed by processor 101, or any other device. For example, executable code and/or data of a variety of operating systems, device drivers, firmware (e.g., input output basic system or BIOS), and/or applications can be loaded in the memory 103 and executed by processor 101. That is, the memory 103 can be any type of non-transitory storage medium that can be accessed by the processor 101 to perform various examples of the present disclosure. For example, the memory 103 can be a non-transitory computer readable medium having computer readable instructions (e.g., computer program instructions) stored thereon that are executable by the processor 101.

According to an embodiment, the sensor 105 is a motion sensor 105 to detect motion of the device when the operator maneuvers in the facility 100. The motion sensor 105, for example, is an accelerometer, gyroscope, a magnetometer, a light sensor, compass, a proximity sensor, or a combination thereof. The sensor 105 may be a part of onboard circuitry or coupled to the device. Such motion sensor 105 may be used to determine whether the device is idle or is moving. According to an embodiment, a time duration the device is idle may be ascertained from sensor measurements of the motion sensor 105 to determine whether the device is transitioned to a sleep/idle state from an active state. In some examples, the device is in the sleep/idle state if the operator handling the device is far from the device at a different location within the facility 100, for example, the operators handing the first device 102 and the fourth device 108 as shown in FIG. 1. In some examples, the device is in the active state if the operator handling the device is moving with the device to various locations within the facility 100, for example, the operator handing the second device 104 as shown in FIG. 1.

According to an embodiment, the wireless transceiver 107 is a Bluetooth Low Energy (BLE) transceiver to at least transmit and receive beacon signals in the form of advertising data packets between the devices. Those skilled in the art will recognize that the BLE transceiver 107 may operate in differing frequency ranges. Those skilled in the art will recognize that the BLE transceiver 107 provide the devices the capability to exchange information in a non-connected state, that is, the devices need not to be paired. According to an embodiment, the advertising data packets may be provided in a particular packet format which is discussed in detail in conjunction with FIG. 2. It is understood that the advertising data packets supports multiple protocols, for example, AltBeacon Protocol, Google Protocol and iBeacon Protocol. Each wireless transceiver 107 transmits the advertising data packets at predefined time interval, for example, one second. According to another embodiment, other types of wireless transceivers may be employed, for example, Wireless a Wi-Fi transceiver, an infrared transceiver, a WiMAX transceiver, a wireless cellular, telephony transceiver, a satellite transceiver (i.e., a global positioning system (GPS) transceiver), or other radio frequency (RF) transceivers, network interfaces (e.g., Ethernet interfaces) or a combination thereof.

According to an embodiment. the BLE transceiver 107 receives a Received Signal Strength Indicator (RSSI) value in the advertising data packets which is a measurement of the power present in a received radio signal. RSSI measurements can be used to estimate a distance to a BLE device that transmitted the BLE signal. In general, greater the distance between the devices, the lesser the strength of the received BLE signal. According to an embodiment, a database table in the memory 103 can include an association between the received signal strength indicator measured by a device and a message is trigged to the interface 109 of the device based on the association. In some examples, the database includes RSSI range class (e.g., Far, Near, Immediate) derived from the received signal strength. In some examples, the database includes distance ranges (e.g., less than 6 feet, equal to 6 feet, greater than 6 feet, between 6 feet-12 feet) derived from the received signal strength. The device may trigger an appropriate message to the interface 109 of the device and other nearby devices based on the distance. In some examples, the device may triangulate and/or trilaterate (multilaterate) a location of the device in the facility 100 based on the received signal strength indicator value of the BLE signals received from other nearby devices.

According to an embodiment, the interface 109 is either a visual interface or audio interface or their combination. The visual interface may include a display and the audio interface may include a speaker. The display may be a touch sensitive screen. Further, the audio interface may include a microphone to facilitate voice-enabled functions, such as voice recognition, voice replication, digital recording, and/or telephony functions. According to an embodiment, an alert is generated at either the visual interface or the audio interface or both when the social distancing criteria is breached. For example, the display may turn red in color and blink several times to alert the operator while providing a tactile or force feedback such as vibration to the device and providing an audible sound such as a buzzer sound through the speaker. In some examples, an LED or other illumination means may emit a visual alert, such as, by emitting a solid light or flashing light to alert the operator. According to an embodiment, another alert is generated at either the visual interface or the audio interface when the social distancing criteria is met. For example, the display which is blinking in red may turn to green or to normal screen while terminating the buzzing sound and the vibration.

According to an embodiment, the central computing device 110 comprises the processor 101, the memory 103, the sensor 105, the wireless transceiver 107, and the interface 109 similar to the multiple devices 102,104,106,108 within the facility 100. In addition, the central computing device 110 may include a device tracker module 111 to track the devices within the facility 100. For example, the central computing device 110 may include a list of devices which are in the active state and a list of devices which are in the sleep/idle state. The device tracker module 111 may be in the form of a software application which can track the devices which are in the sleep state and activate it using options provided at the interface 109 of the central computing device 110. An example embodiment of the central computing device 110 identifying a lost device 108 (i.e., a device that has entered the sleep/idle state for prolonged time duration) and activating the lost device 108 through the interface 109 is explained in detail in conjunction with FIG. 4.

As shown in FIG. 1, dotted lines around the first device 102, the second device 104, the third device 106, and the fourth device 108 indicate a BLE coverage range of these devices. It is shown that the BLE coverage range of the first device 102, the second device 104, and the third device 106 overlap with each other. In this regard, the first device 102, the second device 104, and the third device 106 may start transmitting and receiving beacon signals to and from each other as the dotted lines (i.e., the BLE coverage range) overlap. As shown in FIG. 1, the fourth device 108 does not fall within the BLE coverage range of the other three devices, hence may not transmit or receive the beacon signals from the other three devices. It is also seen that the operator of the'fourth device 108 is far away from the fourth device 108, hence, the fourth device 108 remains in an idle state/sleep state. In this regard, after a predefined time duration, the fourth device 108 may be considered as a lost device 108 within the facility 100 cut off from the other devices 102, 104, 106 within the facility 100. An example embodiment of the present disclosure as discussed in FIG. 4, discloses a technique for identifying such lost devices 108 within the facility 100. According to an embodiment, the beacon signals from the multiple devices 102,104,106,108 are transmitted in the form of advertising data packets which will be details in conjunction with FIG. 2. For purpose of explanation of such communication of the beacon signals between multiple devices 102,104,106,108 which are in the BLE coverage range, let us assume the communication between two devices, for example, the first device 102 and the second device 104. It is understood to a person skilled in the art that such communications are not limited only to two devices and is applicable to multiple devices 102,104,106, 108 within the facility 100. For example, a first device 102 can communicate and process the beacon signals of both the second device 104 and the third device 106. Likewise, the second device 104 and the third device 106 can demonstrate similar communication and processing of the beacon signals.

As shown in the example embodiment in FIG. 1, the first device 102 and the second device 104 are within the BLE coverage range and automatically pair with each other. Once the pairing is established, the wireless transceiver 107 of the first device 102 receives first beacon signals from the second device 104 and transmits second beacon signals to the second device 104 and at the same time the wireless transceiver 107 of the second device 104 transmits the first beacon signals to the first device 102 and receives the second beacon signals from the first device 102. According to an embodiment, when the devices are within the BLE connectivity range, the first device 102 transmits the first beacon signals and continues to transmit subsequent beacon signals to the second device 104 and the second device 104 transmits the second beacon signals and continues to transmit subsequent beacon signals to the first device 102. In this regard, when the pairing is established, the first device 102 and the second device 104 mutually communicate with each other by transmitting and receiving the beacon signals. The beacon signals of the first device 102 and the second device 104 are processed by the processor 101 to determine if one or more conditions associated with the first device 102 and the second device 104 is satisfied. According to an embodiment, the one or more conditions are based on the beacon signals (i.e., a payload of the advertising data packets). In some examples, the processor 101 may look up to the database table in the memory 103 which stores predefined ranges (such as RSSI range class and distance ranges) as previously discussed to identify if the one or more conditions are satisfied. In response to the one or more conditions being satisfied, the processor 101 may generate an alert through the interface 109 such that operators of both the first device 102 and the second device 104 are aware of the social distancing breach. The one or more conditions to generate the alert for maintaining the social distancing are explained in the example flow diagram of FIG. 3 and the flowchart of FIG. 5.

Figure 2:
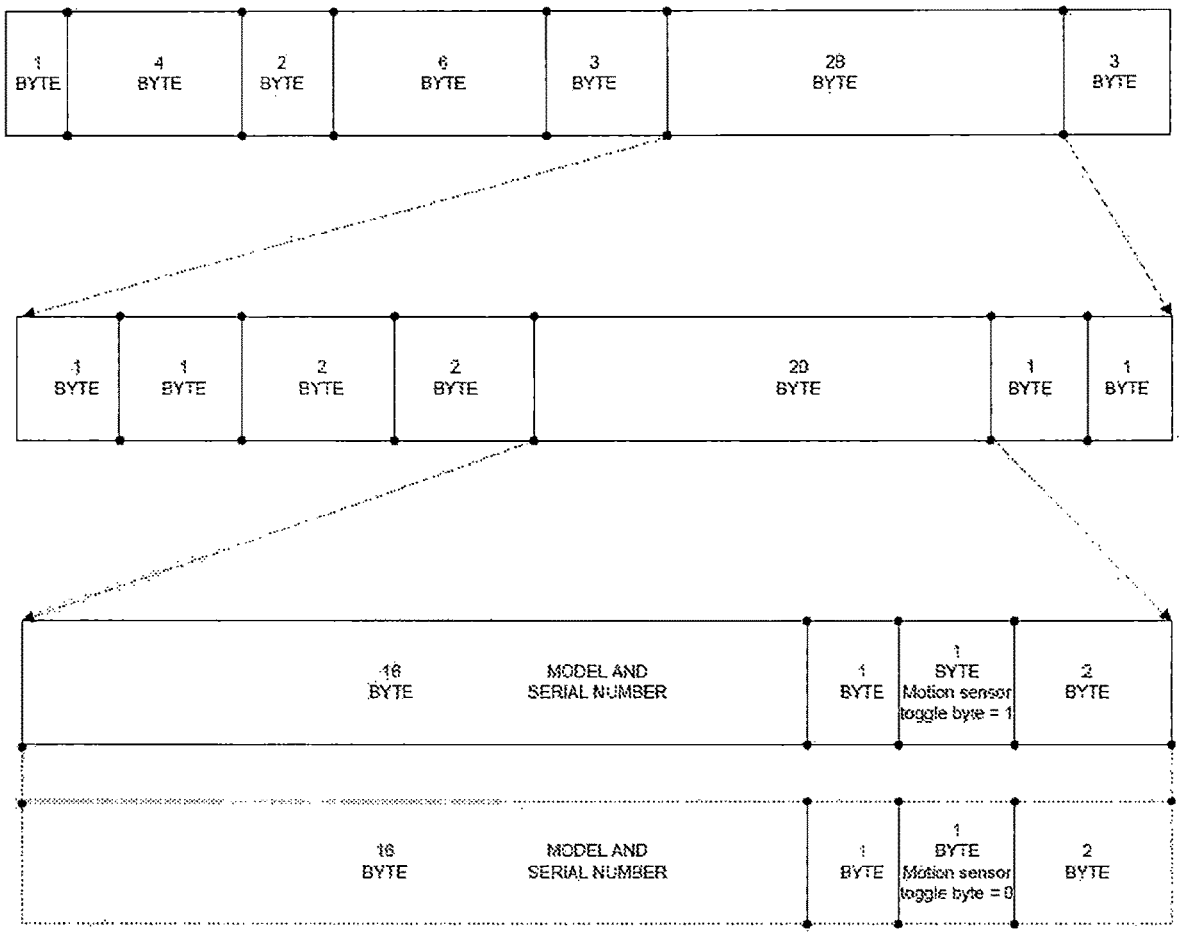
FIG. 2 illustrates a block diagram describing packet format of an advertising data packet communicated between the network of mobile devices, in accordance with an embodiment of the present invention.

According to an embodiment, the beacon signals are communicated between the multiple devices 102,104,106, 108 in the form advertising data packets. Referring to FIG. 2, a block diagram describing packet format of an advertising data packet communicated between the network of mobile devices is shown. The devices communicate by transmitting and receiving the advertising data packets in the packet format as shown in FIG. 2. For example, once the first device 102 is discovered by the second device 104 or vice-versa, a connection is initiated and both the devices periodically transmit the advertising data packets and may respond with more information upon request from other devices. A size of payload data available in the advertising data packet as shown in FIG. 2, for example, is up to forty-seven (47) bytes. The advertising data packet referred to as PDU (Protocol Data Unit) includes a header and a payload that can be detected by the devices in connection with each other. As shown in the example of FIG. 2, the advertising data packet follows an Altbeacon advertising protocol which comprises a 1 byte preamble field, a 4-byte address field, 2 byte PDU header field, 6 byte ADvA, 3-byte AD flags, 28 byte BLE advertisement and 3 byte CRC. The contents (data) of the BLE advertisement contains information that the receiving BLE enabled device (e.g., the first device 102) can use to identify the transmitting BLE enabled device (e.g., the second device 104) and compute a relative distance between the receiving BLE enabled device (e.g., the first device 102) and the transmitting BLE enabled device (e.g., the second device 104). The receiving BLE enabled device and the transmitting BLE enabled device are interchangeable (i.e., the second device 104 may also identify the first device 102 based on the data in the BLE advertisement) and the computation may occur at both the receiving BLE enabled device and the transmitting BLE enabled device. The 28 byte BLE advertisement comprises a 1-byte length field, 1-byte type field and 2-byte company identifier, as prescribed by the Manufacturer Specific Advertising Data structure format, followed by 24 additional bytes containing the beacon advertisement data. The 24 additional bytes of the beacon advertisement data is divided into 2-byte beacon code, 20-byte beacon ID, 1 byte RSSI (received signal strength indicator), and 1 byte MFG RSVD. The 2-byte beacon code is the AltBeacon advertisement code. The RSSI is a 1-byte value representing the average received signal strength from the transmitting BLE enabled device (for example, the first device 102 or the second device 104). The MFG RSVD is reserved for use by the manufacturer to implement special features. Interpretation of this value is to be defined by the manufacturer and is to be evaluated based on the 2-byte company identifier.

According to an embodiment of the present disclosure, the 20 byte BeaconID is customized and divided into three segments with a first segment including 16 bytes allocated for a model and serial number of the transmitting BLE enabled device (for example, the first device 102 or the second device 104), a second segment with 2 bytes (one byte being an idle byte and the other byte being a motion sensor toggle byte) and a third segment with 2 bytes reserved as filter bytes.

Figure 6:
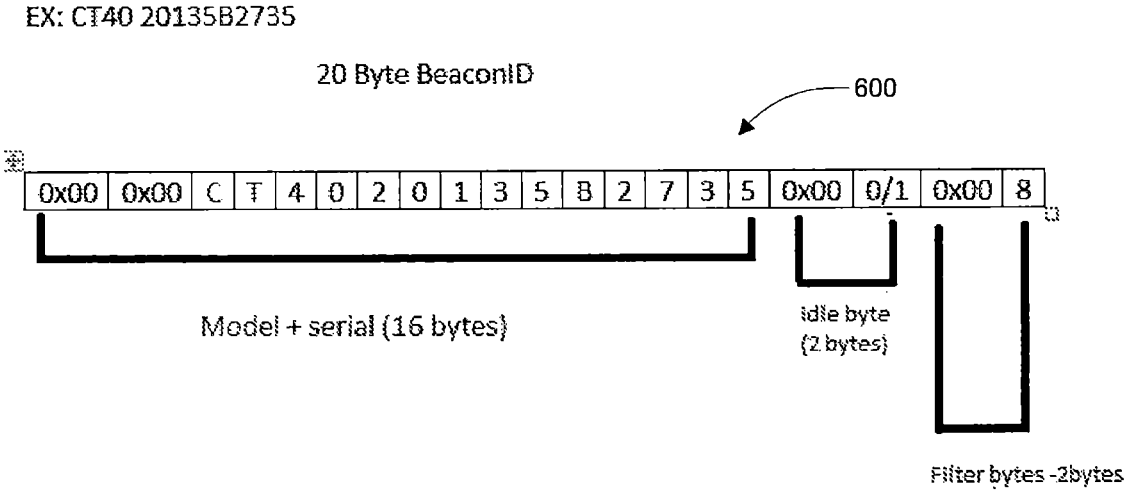
FIG. 6 illustrates an exemplary customized BeaconID in accordance with at least an embodiment of the present invention.

An example BeaconID is illustrated in FIG. 6. Specifically, FIG. 6 illustrates an example 20-byte customized BeaconID 600 in accordance with at least an example embodiment of the present disclosure.

As depicted in the example 20-bye customized BeaconID 600, the model number 'CT40' is followed by serial number '0210135B2735' along with a few bytes left idle for other model numbers collectively accounts up to 16 bytes of the first segment in the 20 byte BeaconID. According to an embodiment, the second byte of the second segment being the motion senor toggle byte can be toggled between a first value and a second value, which in the example 20-bye customized BeaconID 600, is 0/1 based on an output signal from the motion sensor 105 of the transmitting BLE enabled device. For example, a motion status of the transmitting BLE enabled device is reported in the advertising data packet transmission by at least one byte that toggles to represent whether the transmitting BLE enabled device is in the active state or the idle state. For example, the byte value '1' may represent that the device is moving and the byte value '0' may represent that the device is not-moving. According to an embodiment, the motion sensor toggle byte is toggled from 1 to 0 only after a predefined time duration the output signal from motion sensor 105 indicates no movement. In some examples, the last 2 filter bytes may be used to filter out only the devices of a particular manufacturer, for example, Honeywell handheld mobile computers.

Figure 3:
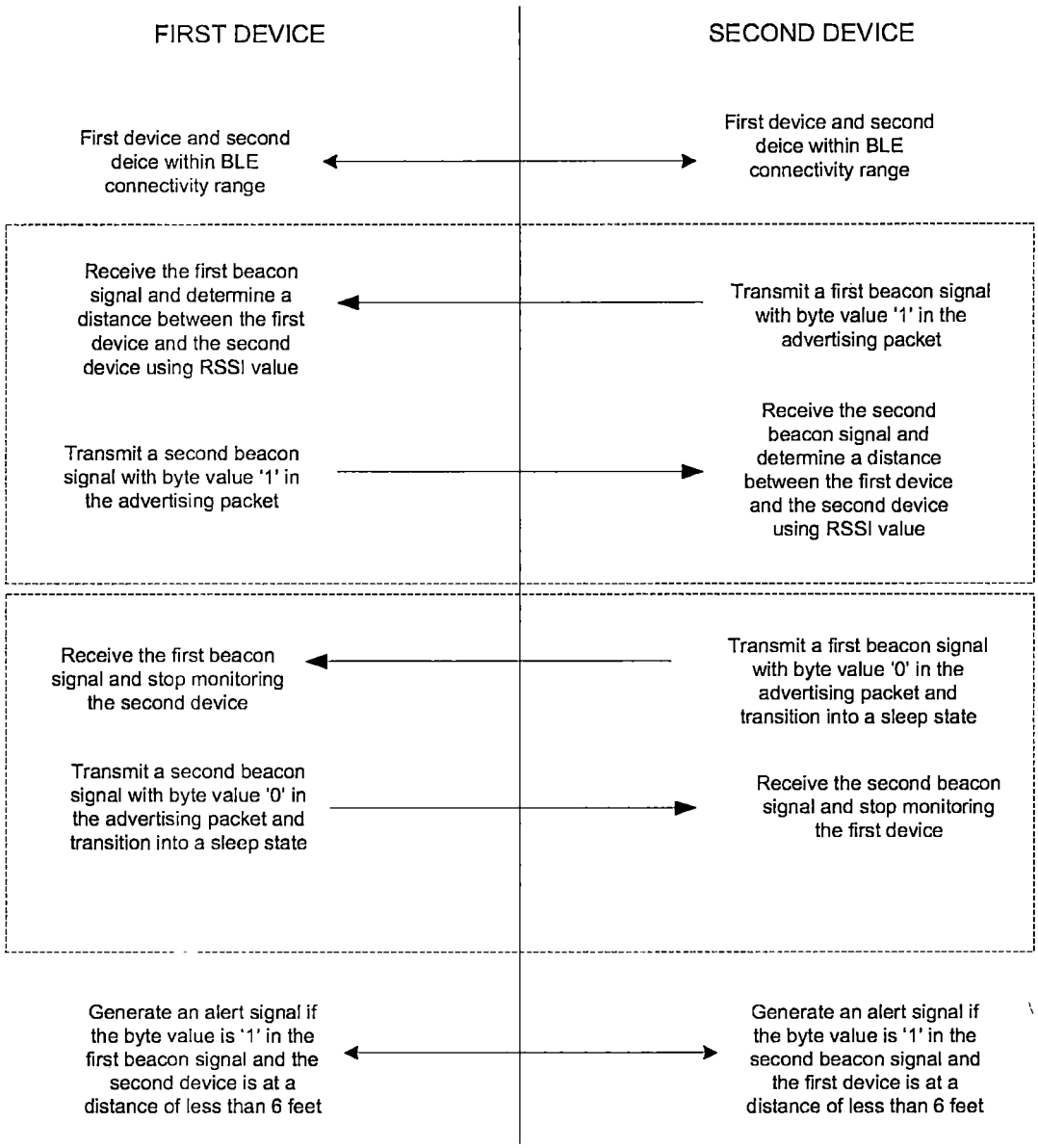
FIG. 3 illustrates a flow diagram describing the interaction of two wireless devices as shown in FIG. 1 to maintain social distancing, in accordance with an embodiment of the present invention.

FIG. 3 illustrates a flow diagram describing the interaction of two wireless devices as shown in FIG. 1 to maintain social distancing, in accordance with an embodiment of the present invention. The interaction will be described in conjunction with two wireless devices, for example, the first device 102 and the second device 104. As discussed previously in conjunction with FIG. 1, the first device 102 and the second device 104 are handled by a first operator and a second operator respectively. The first device 102 and the second device 104 checks for one or more conditions after the advertising data packet is received in the form of the first beacon signal and the second beacon signal. For example, the one or more conditions may be a first condition and a second condition. The first condition can be based on a payload associated with the advertising data packet. The payload, for example, may be the data in the BeaconID associated with the motion sensor 105. The second condition can be based on a distance between the first device 102 and the second device 104. The distance, for example, may be based on RSSI value in the beacon advertisement data. As shown in FIG. 3, both the first device 102 and the second device 104 connect automatically when within the BLE connectivity range 120. According to an embodiment, the second device 104 transmits the first beacon signal in the form of the advertising data packet as shown in FIG. 2 with the motion senor toggle byte set as '1'. The first device 102 receives the first beacon signal and determines the first condition. The first condition is satisfied if the byte in the payload of the advertising data packet is set to '1'. Accordingly, the first device 102 determines the second condition by calculating the distance between the first device 102 and the second device 104 based on the RSSI value in the payload of the advertising data packet when it is determined that the motion sensor toggle byte is set as '1'. In some examples, the distance may be calculated based on a measured power, RSSI value and a constant which may depend upon environmental factors. It is understood that the distance maybe calculated by techniques generally known in the art to determine a proximity between the devices in the facility 100. Turning now to FIG. 3, the dotted lines indicate that the transmission and reception of the first beacon signal and the second beacon signal and the distance calculations can be executed simultaneously at the first device 102 and the second device 104.

According to an embodiment, the calculated distance is compared with a predefined threshold distance. In this regard, the second condition is satisfied only if the calculated distance between the first device 102 and the second device 104 is less than the predefined threshold distance. In some examples, the first device 102 and the second device 104 may start communicating with each other when the distance between the first device 102 and the second device 104 is about 12 feet. In this regard, the predefined threshold distance may be set to 6 feet. Therefore, after initiating the communication at the distance of 12 feet, the calculated distance based on the RSSI value is compared to the predefined threshold distance of 6 feet to determine if the second condition is satisfied.

According to another embodiment, the second device 104 transmits the first beacon signal in the form of the advertising data packet as shown in FIG. 2 with the motion senor toggle byte set as '0'. The first device 102 receives the first beacon signal and determines the first condition. The first condition is satisfied if the byte in the payload of the advertising data packet is set to '1'. Accordingly, the first device 102 stops monitoring the second device 104 when the first condition is not satisfied. Likewise, the second device 104 stops monitoring the first device 102 if the motion senor toggle byte set as '0' in the second beacon signal. Therefore, if the first condition is not satisfied after receiving the first beacon signal, the first device 102 stops monitoring the second device 104 and if the if the first condition is not satisfied after receiving the second beacon signal, the second device 104 stops monitoring the first device 102. In other words, when the first beacon signal has the byte set as '0', then the first device 102 stops determining the second condition by calculating the distance from the first device 102 to the second device 104. Similarly, when the second beacon signal has the byte set as '0', then the second device 104 stops calculating the distance from the second device 104 to the first device 102. Accordingly, if the first condition is not satisfied in the received beacon signals, then the second condition is not determined by the first device 102 and the second device 104. As shown in example embodiment of FIG. 1, the motion senor toggle byte may toggle from 1 to 0 when the operator handling the first device 102 leaves it idle at a first location for a predefined time duration and moves to a second location within the facility 100. Turning now to FIG. 3, the dotted lines indicate that the transmission and reception of the first beacon signal and the second beacon signal and the monitoring can be executed simultaneously at the first device 102 and the second device 104. According to an embodiment, the first device 102 and the second device 104 may continue to transmit its beacon signals to other devices even if the motion sensor toggle byte is set to '0', however, the first device 102 and the second device 104 ceases monitoring the beacon signals transmitted from the other devices. According to an embodiment, the motion sensor toggle byte may be any value other than '0' or '1'.

As discussed previously, an alert signal is generated at the first device 102 and the second device 104 if the first condition and the second condition is satisfied. The table 1.1 below shows an example of when the alert signal is generated according to the first condition and the second condition applicable for both the first device 102 and the second device 104. It is understood to a person skilled in the art that the determination of the first condition and the second condition can be performed by all the devices within the facility 100 which are in the BLE connectivity range 120.

TABLE 1.1

| Motion sensor toggle byte (First condition) | Distance in Feet (<6 ft) (Second Condition) | Alert signal generated |
|---|---|---|
| 0 | Yes | No |
| | No | No |
| 1 | Yes | Yes |
| | No | No |

As shown in the table 1.1, the alert signal is generated only if both the first condition and the second condition are satisfied. For example, as shown in FIG. 2, the first device 102 generates an alert signal if the motion sensor toggle byte is '1' in the first beacon signal and the second device 104 is at a distance of less than 6 feet. Similarly, the second device 104 generates an alert signal if the byte value is '1' in the second beacon signal and the first device 102 is at a distance of less than 6 feet. In this regard, the first device 102 and the second device 104 checks for the first condition and the second condition. According to an embodiment, the first device 102 and the second device 104 may refrain from checking the second condition if the first condition is not satisfied. As shown in the table above, the first condition is the motion sensor toggle byte should be equal to 1 and the second condition is the distance between the first device 102 and the second device 104 should be less than 6 feet. The permutation and combination of the first condition and the second condition to generate the alert is shown in the above table. According to an embodiment, as shown in FIG. 3, the alert may be generated at the both the first device 102 and the second device 104 as the transmission, reception and processing of the beacon signals occur simultaneously. Accordingly, as shown in Table 1.1, if the first condition is not satisfied and the second condition is satisfied, then the alert signal is not generated. According to an embodiment, if the first condition is not satisfied, then the second condition is not determined. According to another embodiment, if the second condition is determined first followed by the first condition, then then the alert signal is not generated if the first condition is not satisfied. According to an embodiment, if the first condition is satisfied and the second condition is not satisfied, then the alert signal is not generated as the second condition is not satisfied. In this regard, it is understood that the alert is generated only if the device is in motion and the distance is less than the predefined threshold distance. Accordingly, a possibility of a false proximity alert generated due to the presence of an idle device is mitigated by monitoring the output signal from the motion sensor 105 of the device transmitted in the form of a toggle byte in the payload of the advertising data packet.

Figure 4:
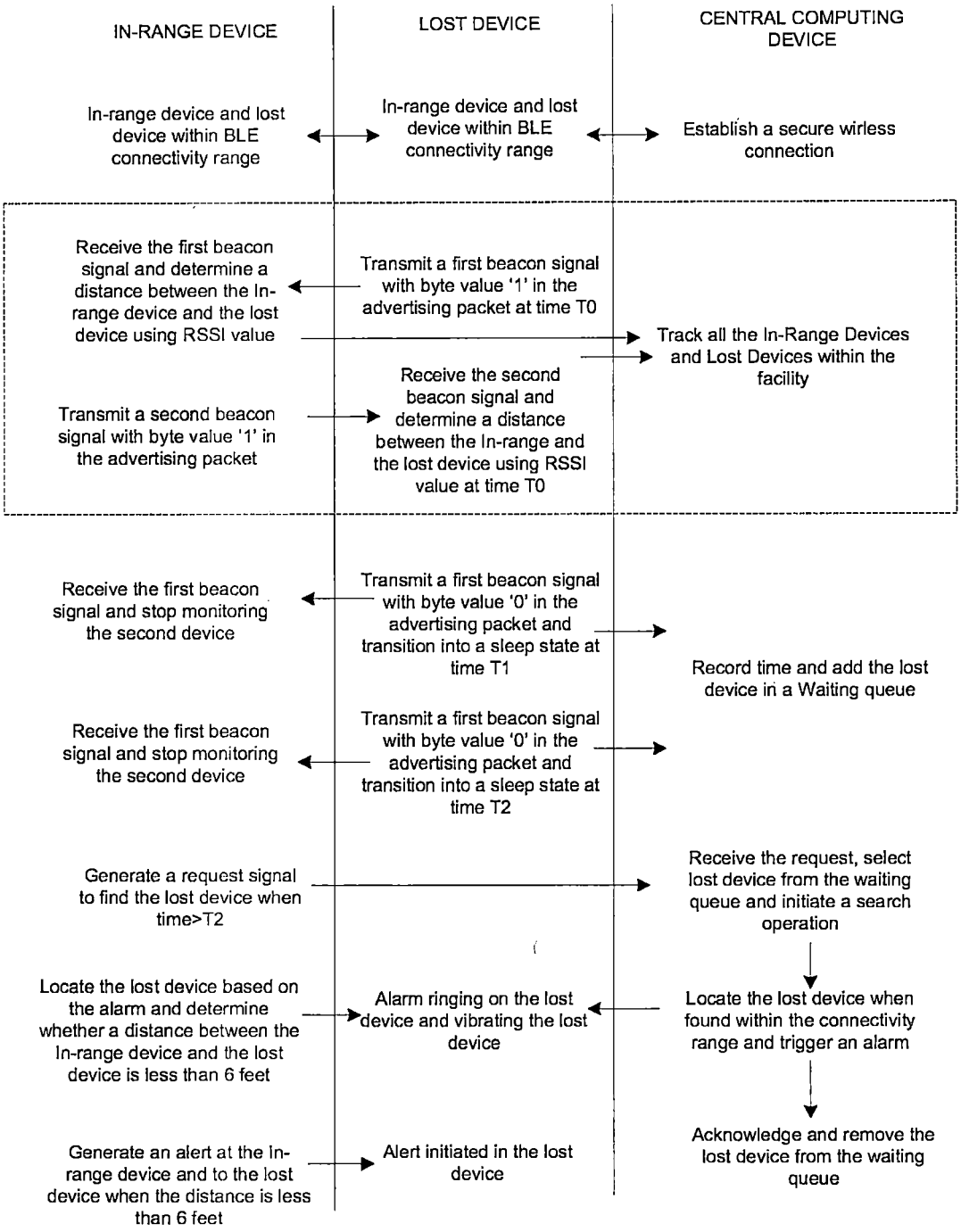
FIG. 4 illustrates a flow diagram describing the interaction of three wireless devices to find a lost device and to maintain social distancing, in accordance with an embodiment of the present invention.

FIG. 4 illustrates a flow diagram describing the interaction of three wireless devices to find a lost device and to maintain social distancing, in accordance with an embodiment of the present invention. As discussed previously, the central computing device 110 monitors all the devices within the facility 100. In the example embodiment shown in FIG. 4, the three wireless devices are in-range device 102,104, 106, lost device 108 and a central computing device 110. As shown in FIG. 4, the term in-range device 102,104,106 may refer collectively or solely to the first device 102, the second device 104 and the third device 106 which are within the BLE connectivity range 120 and in connection with each other. The lost device 108 may be the fourth device 108 which is not within the BLE connectivity range 120 and not in connection with any other device in the facility 100. The term lost device 108 and the fourth device 108 may be used interchangeably hereinafter in the description. As discussed previously, the central computing device 110 may be configured to track the lost device 108 and the in-range device 102,104,106 using the device tracking module. In some examples, the device tracking module provides a user interface 109 with a list of lost devices 108 in the form of a waiting queue based on a time at which a connectivity was lost for the lost devices 108. In some examples, the user interface 109 may display the device serial number of the lost device 108 along with a symbolic representation of the connectivity range 120 in the form of circles. Further, the user interface 109 may display a dynamically changing text when searching the lost device 108. Let us assume that the fourth device 108 in FIG. 1 is in connection with other in-range device 102,104,106 at time T0. At that instant of time T0, the lost device 108 and the in-range device 102, 104,106 are in wireless communication with the central computing device 110. The lost device 108 and the in-range device 102,104,106 are in communication with each other (i.e.,) BLE communication between these devices are established and the devices are ready for transmission and reception. As shown in FIG. 4, a first beacon signal with byte value '1' in the advertising data packet is transmitted to the in-range device 102,104,106 at time T0 and simultaneously a second beacon signal with byte value '1' in the advertising packet is transmitted to the lost device 108. At that instant of time T0, since the byte value '1' is set in the advertising data packet, the RSSI value of the first beacon signal and the second beacon signal are processed to calculate the distance between the in-range device 102,104,106 and the lost device 108. At that instant of time T0, the central computing device 110 keeps a track of the in-range device 102,104,106 and the lost device 108. For example, the location, the distance, the serial number, and other like parameters may be tracked by the central computing device 110. As shown in FIG. 4, the dotted lines indicate that the transmission, the reception, the processing and the tracking occur simultaneously. Further, at time T1, the lost device 108 may transmit a first beacon signal with byte value '0' in the advertising data packet and transition into a sleep state. For example, the lost device 108 may be idle at time T1 and therefore the lost device 108 may transition into the sleep state while transmitting the advertising data packet to the in-range device 102,104,106. At that instant of time T1, the in-range device 102,104,106 may receive the first beacon signal and identify that the lost device 108 is in idle state based on the byte value in the advertising data packet and ceases to monitor the lost device 108. In other words, the in-range device 102,104,106 does not calculate the distance between the in-range device 102,104,106 and the lost device 108 as the lost device 108 is in the idle state. As discussed previously, when the lost device 108 is in the idle state, it continues to transmit the beacon signals, however, stops receiving the beacon signals from other devices. In this regard, at time T2, the lost device 108 in the idle state continues to transmit the first beacon signal with byte value '0' in the advertising data packet. Accordingly, the central computing device 110 adds the lost device 108 to the waiting queue with a timestamp recording that the lost device 108 is missing/lost within the facility 100 for a predefined duration of time (T2–T1). At the same instant of time T2, the in-range device 102,104,106 may also identify that the lost device 108 remains to be idle for the predefined duration of time. In such scenario, the in-range device 102,104,106 may request the central computing device 110 to initiate a search operation to search the lost device 108 which is idle for the predefined duration of time. According to another embodiment, instead of the in-range device 102,104,106 placing a request, the central computing device 110 may initiate a search operation to search the lost device 108 after the predefined duration of time has lapsed. As shown in FIG. 1, the lost device 108 remains idle for a prolonged time when the operator of the lost device 108 (e.g., the fourth device 108) has placed the lost device 108 idle at a certain location in the facility 100 and moved to a different location or might have forgotten the location of the lost device 108. According to an embodiment, when the in-range device 102,104,106 requests the central computing device 110 to initiate a search operation, the central computing device 110 receives the request, selects the lost device 108 from the waiting queue and initiates the search operation. For example, an operator of the central computing device 110 may initiate the search operation through the user interface 109 by entering the lost device 108 serial number in the device tracker application on the central computing device 110. The device tracker application may start the search operation to find the lost device 108. In some examples, the search operation may occur via local area wireless communication network or a wide area wireless communication network to find the lost device 108. In some examples, the user interface 109 may display the device serial number of the lost device 108 along with a symbolic representation in the form of circles representing whether the device is found within the wireless network range of the central computing device 110. In some examples, a dynamically changing text based on the identification of the lost device 108 within the wireless network range may be superimposed along with the symbolic representation. For example, the text displayed may be the word 'FOUND' with the color of the circles being yellow when the lost device 108 is found within the wireless network range and the text displayed may dynamically change from the word 'FOUND' to 'ALMOST THERE' with the color of the circles being green when the lost device 108 is in proximity to the central computing device 110 or to the in-range device 102,104,106 within the facility 100. Turning now to FIG. 4, when the lost device 108 is found, the central computing device 110 may trigger an alarm at the lost device 108. For example, a bell icon on the user interface 109 may be triggered internally by the device tracker application or externally by the operator in response to finding the lost device 108. Accordingly, the lost device 108 may ring and vibrate providing an audible sound to the operator nearby the lost device 108 to identify precise location of the lost device 108 and recover the lost device 108 within the facility 100. In response to locating the lost device 108 within the facility 100, the operator may provide an acknowledgement through the user interface 109 of the central computing device 110 that the device is found and may remove the lost device 108 from the waiting queue as the lost device 108 is now active and in motion. On the other hand, the in-range device 102,104,106 starts monitoring the lost device 108 as it is now active and in motion. For example, the in-range device 102,104,106 starts monitoring the lost device 108 to determine the distance and proximity of the in-range device 102,104,106 from the lost device 108 and generates an alert if the lost device 108 is at a distance of less than 6 feet from the in-range device 102,104,106.

Figure 5:
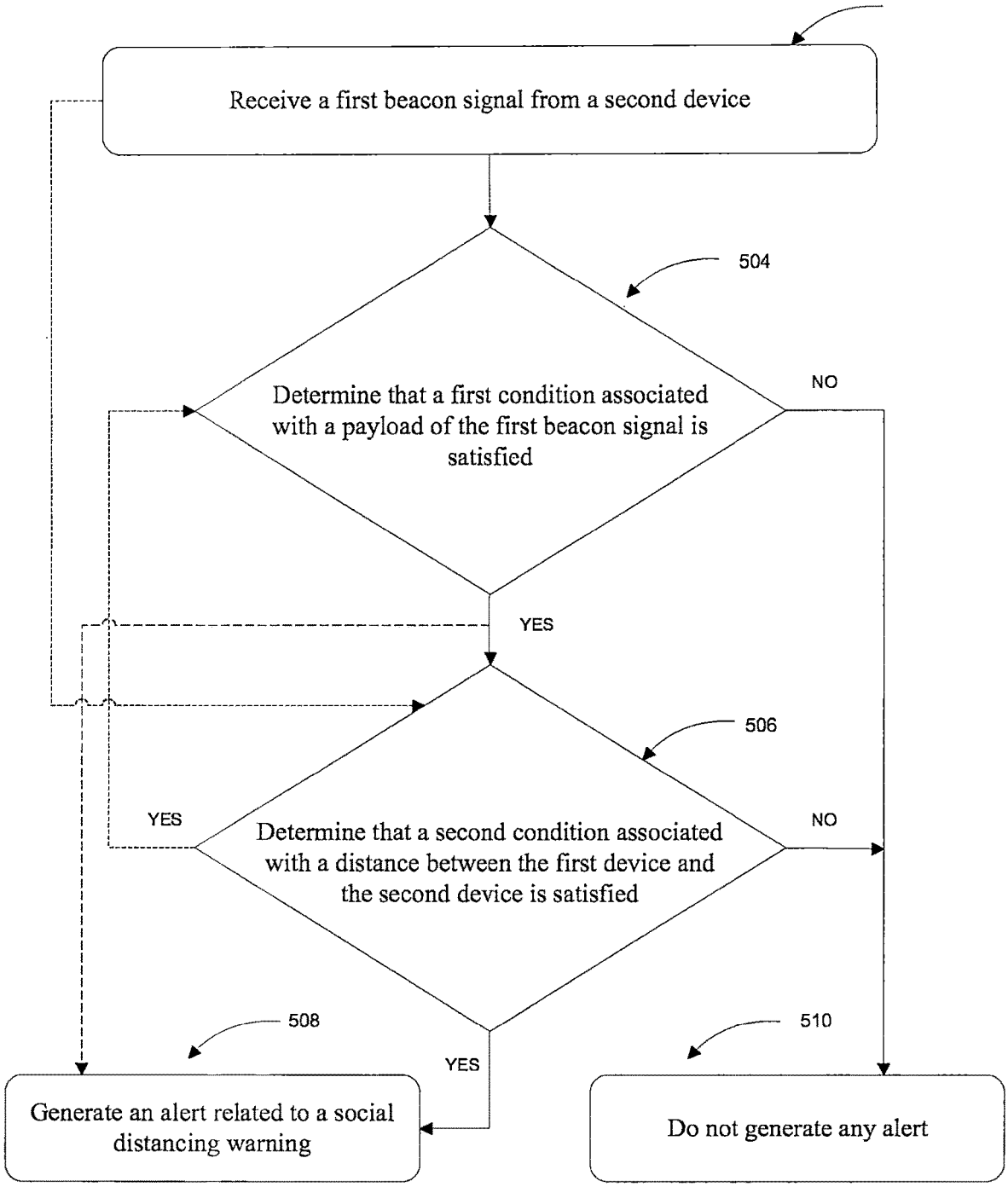
FIG. 5 illustrates an exemplary flow diagram illustrating a method for generating an alert on the mobile devices of FIG. 1 when there is a social distancing breach, in accordance with an embodiment of the present invention.

FIG. 5 illustrates an exemplary flow diagram illustrating a method for generating an alert on the mobile devices of FIG. 1 when there is a social distancing breach, in accordance with an embodiment of the present invention. As discussed previously in conjunction with FIG. 1, the first device, the second device, and the third device start initiating transmission and reception when the connectivity range of these devices overlap. The embodiment is described in connection with the first device and the second device, however, a person skilled art would understand that any connected device within the facility can execute the methods steps detailed herein. At step 502, the first device receives a first beacon signal from the second device. The first beacon signal, for example, is transmitted in the form of advertising data packet with payload data as explained in FIG. 2. After the first beacon signal is received at the first device, at steps 504 and 506, the first device determines a first condition and a second condition. The first condition is associated with the payload data of the first beacon signal and the second condition associated with a distance between the first device and the second device. The determination of the first condition and the determination of the second condition are interdependent. For example, the first condition can be determined after the second condition or the second condition can be determined after the first condition. The dotted lines in FIG. 5 represents the flow in which the second condition is executed initially followed by the execution of the first condition. According to another embodiment, if the first condition is not satisfied, then the second condition may not be determined. According to an embodiment, the first condition is satisfied if a byte in the payload data of the first beacon signal is set to a first value and wherein the first condition is not satisfied if the byte is set to a second value. The byte is a motion sensor toggle byte as disclosed in FIG. 2 which indicates whether the second device is in motion or idle. The motion sensor toggle byte toggles in response to the motion sensor detecting no motion for a predefined duration of time. According to an embodiment, the second device ceases monitoring for the beacon signals from other devices when there is no motion detected at the second device. Similarly, when the second device is in motion, the second device determines a payload data of a second beacon signal transmitted from the first device, wherein the payload data is determined based on motion being detected by the motion sensor on the first device within a predefined time period. The second beacon signal is transmitted with a first payload data in response to detecting motion within the predefined time period or with a second payload data in response to not detecting motion within the predefined time period. The first payload data may be transmitted with the motion sensor toggle byte '1' and the second payload data may be transmitted with the motion sensor toggle byte '0'. According to an embodiment, while the second payload data is transmitted, the first device transitions from an active mode to an idle mode, wherein in the idle mode the first device does not receive the payload of the first beacon signal as the first device is not in motion. According to an embodiment, while the first device or the second device is in not in motion or in idle mode, the transmission of the beacon signals are repeated at a predefined time interval, for example, one second. According to an embodiment, while the first device or the second device is in no motion or idle mode, the first device and the second device ceases to monitor the beacon signals from other devices. Since there is no motion recorded by these device when the operator is not present at the location, other devices may refrain from calculating relative distance to these devices which are not in motion. In other words, these devices which are not in motion are not considered for social distancing calculations (i.e., calculating the relative distance) since it is assumed that there is no physical presence of an operator near these devices, otherwise, there exists a possibility of triggering a false proximity alert if the idle devices are considered for social distancing calculations. Therefore, when other devices identify that the motion sensor toggle byte is set to '0' for either the first device or the second device, it refrains calculating the distance to the first device or the second device as other devices are aware that there is no operator at the location of the first device or the second device based on the output from the motion sensor.

According to an embodiment, the second condition is satisfied if the distance between the first device and the second device is less than a predefined distance. As discussed previously, the distance is calculated using the RSSI value in the payload data to estimate a proximity of the first device to the second device such that social distancing between the operators handling the first device and the second device is maintained. Therefore, at steps 504 and 506, if the first device determines that both the first condition and the second condition is satisfied, then at step 508, an alert is generated. In some examples, the alert is generated at both the first device and the second device. If at steps 504 and 506, the first device determines that both the first condition and the second condition is not satisfied, then at step 508, an alert is not generated. The alert may be an audio alert or a visual alert provided at the interface of both the first device and the second device as discussed previously in conjunction with FIG. 1. According to an embodiment, the alert is generated only if both the first condition and the second condition is satisfied. Therefore, by determining the first condition associated with a motion status of the device and the second condition associated with a relative distance between two or more devices, a social distancing between the operators handling the devices may be maintained obviating the possibility of the false proximity alert when the operator is not physically available at the location of the device.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The foregoing description of an embodiment has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. Although only a limited number of embodiments of the invention are explained in detail, it is to be understood that the invention is not limited in its scope to the details of construction and arrangement of components set forth in the preceding description or illustrated in the drawings. The invention is capable of other embodiments and of being practiced or carried out in various ways. Also, in describing the embodiment, specific terminology was used for the sake of clarity. It is to be understood that each specific term includes all technical equivalents which operate in a similar manner to accomplish a similar purpose.

What is claimed is:

1. A first device, comprising:

a processor; and a memory that stores executable instructions that, when executed by the processor, facilitate performance of operations, comprising:

receiving a first beacon signal from a second device;

determining that a first condition associated with a payload of the first beacon signal is satisfied when a byte in the payload of the first beacon signal is set to a first value and wherein the first condition is not satisfied if the byte is set to a second value, wherein the payload of the first beacon signal corresponds to motion information of the second device;

determining that a second condition associated with a distance between the first device and the second device is satisfied;

generating an alert related to a social distancing warning in response to the first condition and the second condition being satisfied; and in response to at least one of the first condition or second condition not being satisfied, not generating the alert.

2. The first device of claim 1, wherein the second condition is satisfied if the distance between the first device and the second device is less than a predefined distance.

3. The first device of claim 2, wherein the operations further comprise:

determining the distance between the first device and the second device based on a received signal strength of the first beacon signal.

4. The first device of claim 1, wherein the alert is at least one of an audio alert or a visual alert.

5. The first device of claim 1, wherein in response to a sensor detecting no motion for a predefined duration of time, ceasing monitoring for beacon signals from other devices.

6. The first device of claim 1, further comprising:

determining a payload for a second beacon signal, wherein the payload is determined based on motion being detected by a sensor on the first device within a predefined time period; and transmitting the second beacon signal with a first payload in response to detecting motion within the predefined time period or a second payload in response to not detecting motion within the predefined time period.

7. The first device of claim 6, further comprising:

transitioning the first device from an active mode to an idle mode in response to transmitting the second beacon signal with the second payload, wherein in the idle mode the first device does not receive the payload of the first beacon signal.

8. The first device of claim 7, further comprising:

repeating the transmission of the second beacon signal at a predefined time interval.

9. The first device of claim 8, wherein the predefined time interval is one second.

10. A method, comprising:

receiving, by a first device comprising a processor, a first beacon signal from a second device;

determining, by the first device, that a first condition associated with a payload of the first beacon signal is satisfied when a byte in the payload of the first beacon signal is set to a first value and wherein the first condition is not satisfied if the byte is set to a second value, wherein the payload of the first beacon signal corresponds to motion information of the second device, and determining, by the first device, that a second condition associated with a distance between the first device and the second device is satisfied, generating an alert related to a social distancing warning; and wherein the determination of the first condition and the determination of the second condition are interdependent; and in response to at least one of the first condition or second condition not being satisfied, not generating, by the first device, the alert.

11. The method of claim 10, wherein the determining that the second condition has been satisfied further comprises determining that the distance between the first device and the second device is less than a predefined distance.

12. The method of claim 11, wherein the determining the distance between the first device and second device is based on a received signal strength of the first beacon signal.

13. The method of claim 10, further comprising:

ceasing monitoring for incoming beacon signals in response to a sensor of the first device detecting no motion for a predefined time period.

14. The method of claim 13, further comprising:

determining, by the first device, a payload for a second beacon signal, wherein the payload is determined based on motion being detected by the sensor within a predefined time period; and transmitting, by the first device, the second beacon signal with a first payload in response to detecting motion within the predefined time period or a second payload in response to not detecting motion within the predefined time period.

15. The method of claim 14, further comprising:

transitioning the first device from an active state to a sleep state when transmitting the second beacon signal with the second payload, wherein in the sleep state the first device does not receive the payload of the first beacon signal.

16. A non-transitory machine-readable storage medium, comprising executable instructions that, when executed by a processor of a device, facilitate performance of operations, comprising:

receiving a first beacon signal from a second device;

in response to determining that a first condition associated with a payload of the first beacon signal is satisfied when a byte in the payload of the first beacon signal is set to a first value and wherein the first condition is not satisfied if the byte is set to a second value, determining that a second condition associated with a distance between the first device and the second device is satisfied, generating an alert related to a social distancing warning; and in response to at least one of the first condition or second condition not being satisfied, not generating the alert.

17. The non-transitory machine-readable storage medium of claim 16, wherein the operations further comprise:

determining a payload for a second beacon signal, wherein the payload is determined based on motion being detected by a sensor within a predefined time period; and transmitting the second beacon signal with a first payload in response to detecting motion within the predefined time period or a second payload in response to not detecting motion within the predefined time period.

18. The non-transitory machine-readable storage medium of claim 16, wherein the operations further comprise:

repeating the transmission of a second beacon signal at a predefined time interval.

* * * * *